US006748727B1

(12) United States Patent
Schulte

(10) Patent No.: US 6,748,727 B1
(45) Date of Patent: Jun. 15, 2004

(54) ADJUSTABLY TORSIONED STIRRUP LEATHER AND SADDLE

(76) Inventor: Frank Schulte, Country Rd., 357 Box 47, Mayo, FL (US) 32066

( * ) Notice: Subject to any disclaimer, the term of this patent is extended or adjusted under 35 U.S.C. 154(b) by 0 days.

(21) Appl. No.: 10/307,491

(22) Filed: Dec. 2, 2002

(51) Int. Cl.[7] ..... B68C 1/16
(52) U.S. Cl. ..... 54/47; 54/46.1
(58) Field of Search ..... 54/47, 46.1

(56) References Cited

U.S. PATENT DOCUMENTS

| | | | | |
|---|---|---|---|---|
| 375,103 A | * | 12/1887 | Stallcup | 54/47 |
| 706,468 A | | 5/1902 | Wellmann | |
| 740,888 A | | 10/1903 | May | |
| 778,090 A | | 12/1904 | Wellmann | |
| 2,482,153 A | | 9/1949 | Cavin | |
| 2,978,855 A | * | 4/1961 | Horst | 54/47 |
| 3,096,552 A | | 7/1963 | Kreger, Jr. | |
| 3,638,395 A | * | 2/1972 | Reidhead | 54/46.1 |
| 4,413,465 A | | 11/1983 | Blevins et al. | |
| 4,531,346 A | | 7/1985 | Brown | |
| D289,698 S | | 5/1987 | Bates | |
| 5,216,874 A | | 6/1993 | Farrow | |
| 6,282,872 B1 | | 9/2001 | Schulte | |

* cited by examiner

*Primary Examiner*—Son T. Nguyen
(74) *Attorney, Agent, or Firm*—Dowell & Dowell, P.C.

(57) ABSTRACT

An adjustable stirrup leather and a saddle including such a stirrup leather for suspending a stirrup relative to a saddle seat wherein a spring element is provided within the stirrup leather to provide a torsional force to properly align the stirrup for a rider's foot when the saddle is placed on a mount. In a preferred embodiment the spring element is vertically adjustable depending upon an adjusted length of the stirrup leather.

19 Claims, 3 Drawing Sheets

ADJUSTABLY TORSIONED STIRRUP LEATHER AND SADDLE

FIELD OF THE INVENTION

This invention is generally directed to improvements in saddlery and more particularly to a stirrup leather for connecting a stirrup to a saddle and combination saddle with stirrup leathers and stirrups wherein each stirrup leather includes a strap which defines an open channel between a front portion and rear portion thereof in which a spring element is received for purposes of providing a torsional force to rotate the leather along it's length so as to preposition the stirrup relative to the saddle seat when the stirrup leather is connected between the stirrup and the saddle seat.

HISTORY OF THE RELATED ART

One of the problems universally encountered in equestrian riding is the alignment of the stirrup relative to a saddle seat when a saddle is placed on a mount. Either when mounting the saddle or when seated on the saddle seat, the rider must often manipulate the stirrup leather in order to properly position a stirrup for receiving the rider's foot.

For instance, when a rider approaches a mount, the stirrup may be positioned at an angle which is not correct for allowing a foot to be inserted within the stirrup in order to mount the horse. Therefore, the rider must either manipulate the stirrup or the stirrup leather in order to pivot the stirrup into a proper position to receive the rider's foot to facilitate mounting.

In a similar manner, once a rider has mounted a saddle, the rider must often re-manipulate the stirrup or the stirrup leather in order to properly align the stirrup to receive the rider's foot while in a riding position.

It would generally be desirable to have the stirrup oriented such that a plane of the opening in the stirrup in which the foot of a rider is received is generally perpendicular to a mount such that the stirrup extends generally perpendicularly outward relative to a saddle seat. This orientation makes the step or base of the stirrup accessible to a rider when mounting and also makes it easier for the rider to position their foot within the opening of the stirrup after mounting.

In order to facilitate such orientation, in applicant's prior U.S. Pat. No. 6,282,872, a torsion spring element is disclosed which can be mounted between portions of the stirrup leather. As disclosed in the patent, the torsion element includes an elongated torsion rod having spaced double hooks or clamps connected thereto for engaging opposite edges of segments of a stirrup strap. Once the segments of the stirrup strap are seated within the jaws of the upper and lower clamps associated with the torsion element, the orientation of the stirrup can be varied by placing a rotational twist on the torsion rod. The amount of twist determines the amount of torsional force developed to orient the stirrup relative to the saddle seat.

Unfortunately, the torsion element disclosed in the aforementioned United States Patent did not allow for adjustment of the length of a stirrup leather in that the torsion element was of a fixed length and generally extended a substantial length along the stirrup leather. In addition, to secure the torsion element to the stirrup leather, it was necessary for the rider to physically place the torsion element in a clamped position to the front and rear segments of the stirrup leather which meant that the torsion element could be easily misplaced when not in use and further that the torsion element could become dislodged from the stirrup leather if accidentally engaged or if the clamping elements became worn over a period of time from repeated use. A further drawback of the torsion element as previously described in the aforementioned patent was that portions of the torsion element were exposed outwardly of the stirrup leather which made it detract from the overall esthetic appearance of the stirrup leather.

In view of the foregoing, there is a need to provide a saddle having a stirrup leather which may be pre-torsioned to provide a specific orientation or positioning of a stirrup relative to a saddle seat when the stirrup leather is positioned therebetween and further which allows the stirrup leather to be universally adjustable for any rider. There is also a need to provide for such a stirrup leather wherein the torsion element associated therewith can not be easily displaced and is esthetically concealed within the leather when in use.

SUMMARY OF THE INVENTION

The present invention is directed to an adjustable stirrup leather which incorporates a torsion element which is mounted in a space defined between a front portion of the stirrup leather and a rear portion thereof and to a saddle including a pair of such stirrup leathers and stirrups. In a preferred embodiment of the invention, the torsion element of each stirrup leather is movably adjustable within the open channel so that if the stirrup leather is adjusted in length, the torsion element may be appropriately repositioned in order to provide the necessary torsional force to orient a stirrup relative to a saddle seat when the stirrup leather is connected between the stirrup and the saddle seat.

In one embodiment of the invention, the torsion element is in the form of an elongated leaf type or flat spring element which is formed of a tempered metallic or plastic material such that the spring may be rotated or twisted about it's longitudinal axis in such a manner that when mounted within a stirrup leather, the spring element will tend to rotate the stirrup leather to a predetermined position. However, the spring element is also capable of being adjusted by further manual manipulation or twisting thereof so that each rider is capable of adjusting the amount of torsional force applied by the spring element after the spring element is positioned within the open channel of the stirrup leather.

In a further embodiment of the invention, the spring element may be selectively seated and retained within the open channel by providing a catch, hook, bail or other element along a length thereof which extends through one or a plurality of spaced access openings which are formed in the rear portion of the stirrup leather. In such an embodiment, the spring element may be inserted through an access opening and moved by sliding relative to the open channel to a seated position within the open channel of the stirrup leather. To adjust the length of the stirrup leather, the spring element may be pulled from the open channel and, after the length of the stirrup leather is adjusted, the torsion element may be inserted into another opening and, by sliding motion, positioned within the open channel at a position to provide effective torsional force for providing a predetermined orientation of the stirrup relative to the saddle seat. As opposed to removing the spring element, the spring element may include one or more slots therein through which a portion of a buckle of the leather stirrup may be selectively inserted as the stirrup leather is adjusted.

In yet another embodiment of the invention, the torsion element, in the form of an elongated soft tempered metal material, may have a pivotal ring, such as a D-ring or bail, associated with an end thereof such that the ring may be used to facilitate the manipulation of the torsion element by pulling and inserting of the torsion element through one of the access openings in the stirrup leather.

It is one of the primary objects of the present invention to provide a torsion element for use in saddlery for providing a predetermined twist to a stirrup leather so as to provide for a predetermined orientation of a stirrup relative to a saddle seat when the stirrup leather is mounted between the stirrup and the saddle seat and the saddle is placed on a mount.

It is a further object of the present invention to provide a torsion element for use with a stirrup leather for connecting a stirrup to a saddle seat wherein the stirrup leather can be provided with a predetermined torsional force but can also be adjusted by manual manipulation of the stirrup leather to place a varied torsional force on the stirrup leather by a torsion element which is mounted within the stirrup leather.

It is yet another object of the present invention to provide a torsion element for providing a predetermined twist to a stirrup leather wherein the torsion element is mounted substantially completely within the stirrup leather so as to promote the overall esthetic appearance of the stirrup leather and prevent any accidental contact with the torsion element which may effect its functioning or result in its misplacement.

It is also an object of the present invention to provide a torsion element for use with a stirrup leather wherein the torsion element may be installed during manufacturing but wherein the torsion element may be easily adjusted by individual riders as required when in use.

BRIEF DESCRIPTION OF THE DRAWINGS

A better understanding of the invention will be had with respect to the drawing figures wherein.

DESCRIPTION OF THE PREFERRED EMBODIMENT

Figure 1:
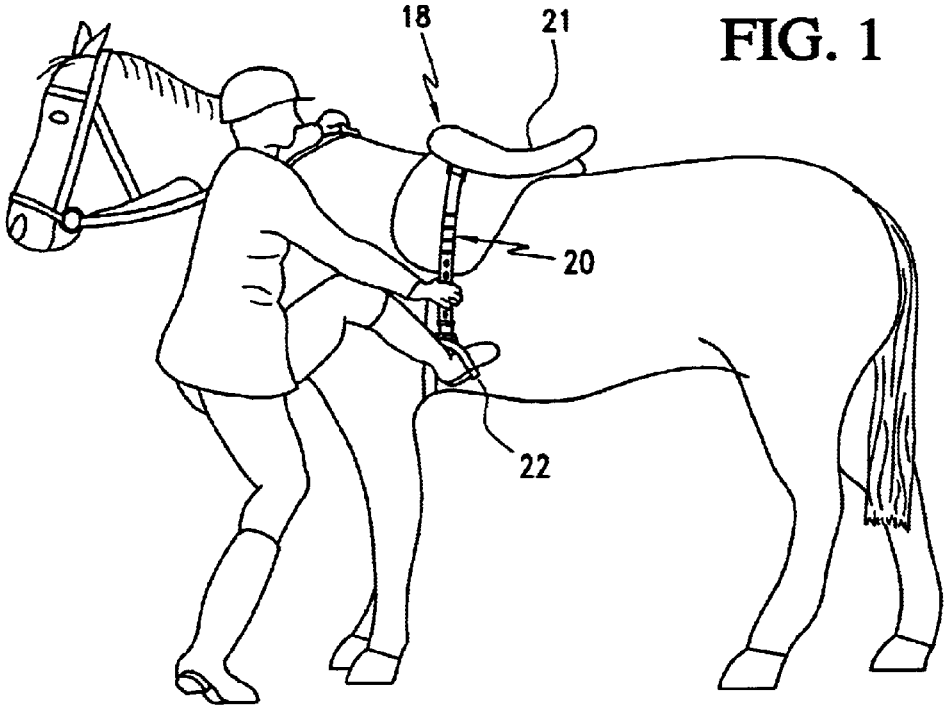
FIG. 1 is a perspective illustrational view showing a saddle in accordance with the present invention showing a stirrup leather mounted between a stirrup and a saddle seat and showing a rider positioning a foot within the stirrup for purposes of mounting a horse.
Figure 2:
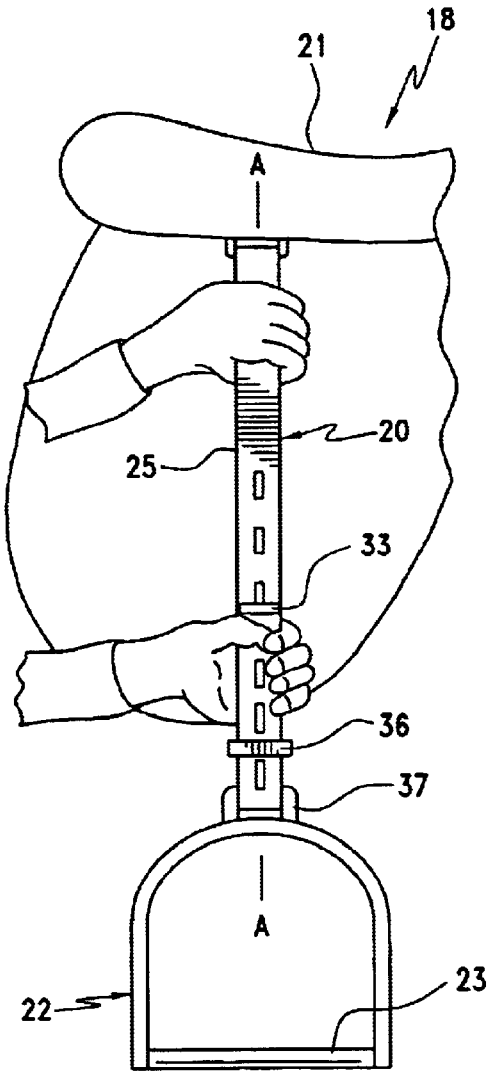
FIG. 2 is a rear view of one embodiment of the stirrup leather in accordance with the teachings of the present invention illustrating an individual placing a varied torsional force on an internal torsional element by the application of force along the length of the stirrup leather so as to cause the stirrup leather to assume a predetermined position, such as shown in FIG. 3.
Figure 3:
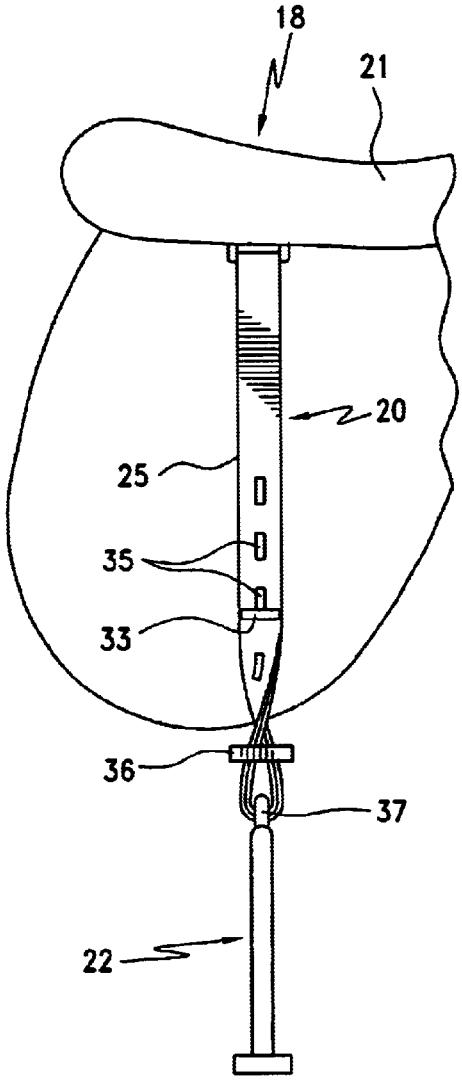
FIG. 3 is a side view showing the stirrup leather torqued or torsioned so as to be normally retained in the position shown therein wherein the stirrup extends generally perpendicularly relative to the saddle seat.

With continued reference to the drawing figures, the invention is directed to a stirrup leather 20 which is preferably adjustable so that the length thereof between a saddle seat 21 and a stirrup 22 can be effectively changed to suit a given rider. The invention is also directed to a saddle 18 having a pair of stirrup leathers 20 and stirrups 22. As illustrated in FIGS. 2 and 3 of the drawings, the saddle leather is specifically designed to provide a torsional force about an elongated axis A—A thereof in order to align the stirrup 22 in the position shown in FIG. 3 wherein the base or step 23 of the stirrup is oriented generally perpendicular to the length of the saddle seat 21. In this position, the opening in the stirrup through which a rider's foot is inserted, as illustrated in FIG. 1, is appropriately aligned to facilitate both mounting and the reorientation and placement of the foot of the rider within the stirrup after the rider has mounted the saddle.

The stirrup leather 20 is shown as being formed as a continuous strap 25 which may be formed of leather or other natural or synthetic material and which is united along its length so as to form an open loop 26 at an upper end thereof and open lower loop 28 at an opposite end thereof. A buckle 30 is normally pivotally connected through the loop 28 to allow adjustment of the length of the strap 25 to suit the stature and leg length of a particular rider. In this respect, there are a plurality of openings through the strap which are much like those in a conventional strap which allow the passage of a keeper of the buckle, such as an H-buckle shown in the drawing figures. The H-buckle includes an inner pivot member 32 which is pivotally mounted within the loop 28 and which is connected to a generally parallel outer keeper element 33 which is integrally formed or connected to the inner pivot 32 by way of a bridge element 34. Other types of buckles and keepers may be used in accordance with the teachings of the present invention.

The buckle keeper 33 is shown as being inserted through one of a plurality of vertically spaced adjustment openings 35 which extend completely through the strap 25.

Figure 4:
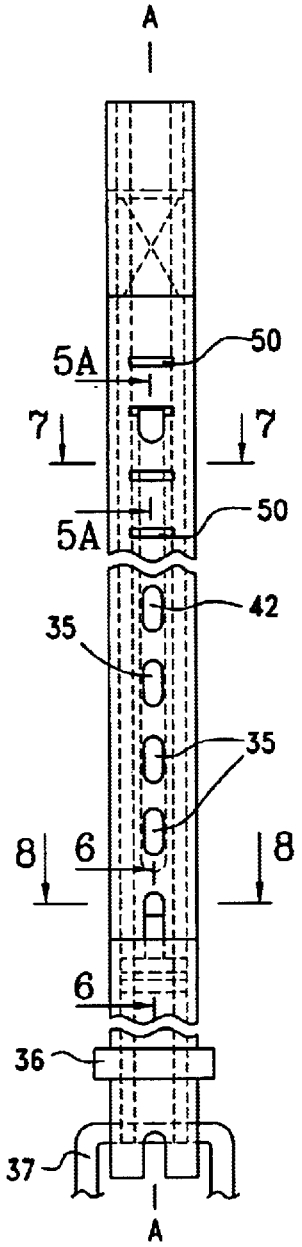
FIG. 4 is a rear view of a stirrup leather in accordance with the teachings of the invention having portions broken away showing a torsion element being selectively positioned within one of a plurality of positions in accordance with the teachings of the invention.
Figure 5:
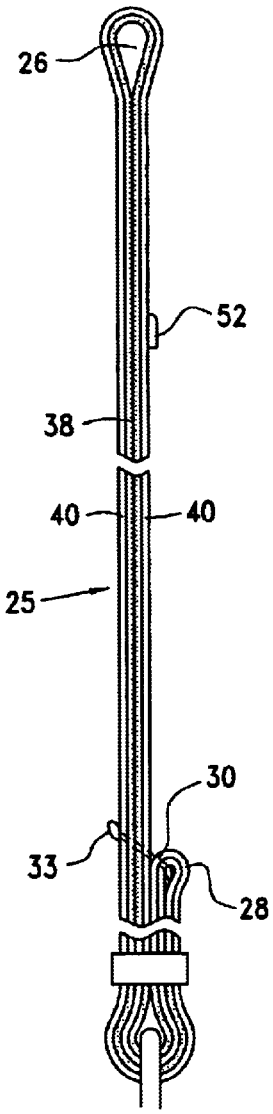
FIG. 5 is a side view of the stirrup strap of FIG. 4.

As shown in FIGS. 4 and 5, the strap extends through a keeper ring 36 which is mounted about the strap adjacent the lower end portion thereof. The strap extends through the keeper ring and through a "D" or other ring element 37 secured or formed integrally with the upper portion of the stirrup 22, as is shown in FIGS. 2 and 3. Thereafter, the end loop 28 is reinserted through the keeper ring 36 and the buckle keeper element 33 selectively inserted through one of the vertically spaced openings 35 with the keeper element oriented vertically. Thereafter, the keeper element 33 is rotated horizontally to thereby retain the looped end portion open lower loop of the strap in an adjusted position, as is illustrated in FIG. 3.

Figure 6:
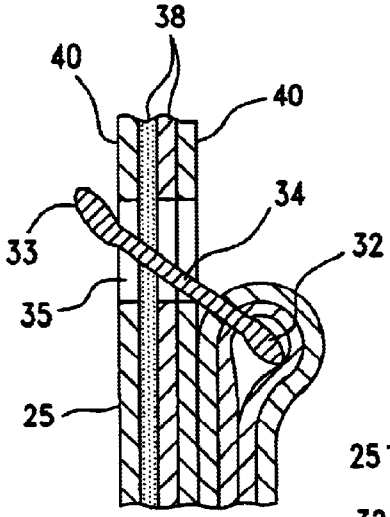
FIG. 6 is an enlarged cross-sectional view taken along line 6—6 of FIG. 4.
Figure 8:
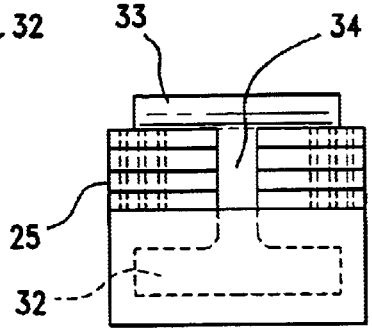
FIG. 8 is an enlarged cross-sectional view taken along line 8—8 of FIG. 4.

Although the strap 25 may be formed of a single piece of natural or synthetic material, such as leather or simulated leather, in the drawing figures, the strap is shown as having a continuous inner lining 38 which is secured to the inner surface of the outer strap material 40. For purposes of definition, the portion of the stirrup leather which is viewable in FIG. 2 is referred to as the front of the stirrup leather whereas the reverse surface is referenced as the rear surface. Therefore, the adjustable end of the stirrup leather generally extends along the rear surface of the stirrup leather, as is illustrated in FIGS. 5 and 6. It should also be noted that the vertically spaced opening 35 extend not only through the outer material 40 but also through the inner liner material 38.

As previously discussed, the purpose of the present invention is to provide for a predetermined orientation of the stirrup 22 relative to the saddle seat 21, such as illustrated in FIG. 3. In this respect, the stirrup leather is designed to selectively receive a torsion spring element therein for purposes of providing a predetermined twist to the stirrup strap, as is also illustrated in FIGS. 2 and 3. Although the form of the torsion element may vary, in the preferred embodiment shown, the torsion spring is formed as an elongated generally flat spring element 42 having an upper end portion 43 and lower end portion 44. The spring element is preferably formed of a somewhat soft tempered stainless steel material or may be formed of other metal or a tempered plastic material which is capable of permitting a torsional force to be exerted thereon with the spring returning to a pre-set axial orientation as is described herein.

Figure 9:
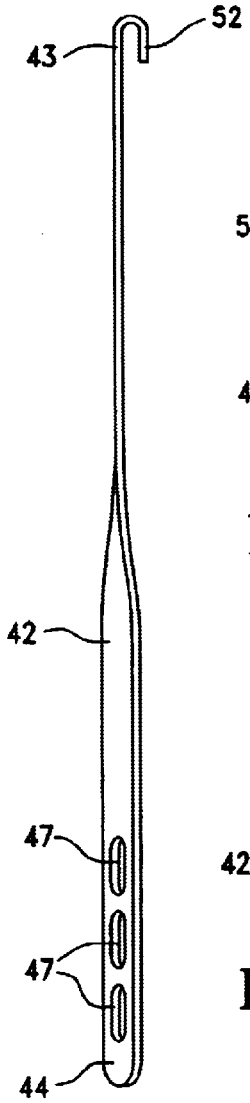
FIG. 9 is a perspective view of one embodiment of torsion spring element as shown with a pre-set twist as taught in accordance with the invention.

As shown in FIG. 9, the torsion spring element 42 may be pre-formed such that the length of the spring element provides a resilient twist, as is illustrated, such that the upper end portion 43 is generally oriented approximately 90 degrees relative to the lower end portion 44. The material, however, is such that, after the torsion element is inserted within an elongated open channel 45 formed generally centrally of, and intermediate, the front and rear positions outer strapment of the stirrup leather, a rider may provide additional torsional twist to the spring element, as is illustrated in FIG. 2, to provide a desired orientation of the stirrup relative to the saddle seat.

The material from which the spring element 42 is made allows the stirrup to be rotated when mounting or when riding but will provide sufficient force to rotate the stirrup to the predetermined position as soon as any counterforce is removed therefrom, such that the stirrup is positioned to facilitate the insertion of a rider's foot into the stirrup as previously described.

Figure 7:
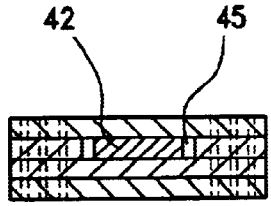
FIG. 7 is an enlarged cross-sectional view taken along line 7—7 of FIG. 4.
Figure 5A:
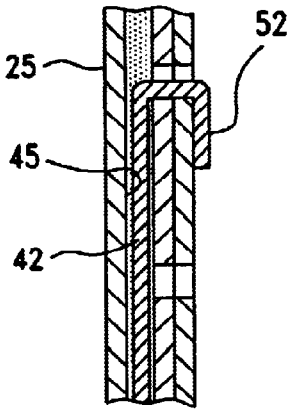
FIG. 5A is an enlarged cross-sectional view taken along line 5A—5A of FIG. 4.

The open channel 45 may be defined by an elongated open space provided between the front and rear portions or surfaces of the stirrup strap. However, where a separate lining material is used, as is shown in the drawing figures at 38, the channel may be formed in a portion of one of the opposing surfaces of the inner lining 38. Such an arrangement is shown in drawing FIGS. 5 and 7.

If the torsion spring element 42 is permanently mounted within the open channel 45, and due to the length of the body of the spring element, it is desirable to provide elongated open slots 47 in vertically spaced relationship along a length thereof extending from the bottom portion 44. The spacing of the open slots and the size thereof is sufficient to accommodate the buckle keeper element 33 associated with the "H" buckle previously described. In this manner, the slots 47 may be aligned with the openings open channel in the strap 25 which permit the length adjustment to the stirrup leather.

In a preferred embodiment of the invention, however, the torsion spring element 42 is designed to be vertically adjustable relative to the stirrup strap depending upon the length of the leather. To facilitate such vertical adjustment, a plurality of spaced openings 50 are provided through the rear surface portion of the outer strap 40, as is illustrated in FIG. 4. The openings 50 communicate with the open channel 45 which extends generally parallel to the elongated axis A—A of the stirrup leather.

Figure 10:
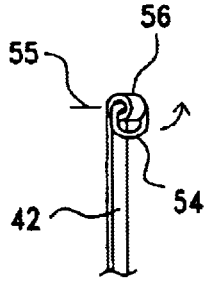
FIG. 10 is a partial perspective view of an alternate embodiment of torsion spring element in accordance with the invention.
Figure 11:
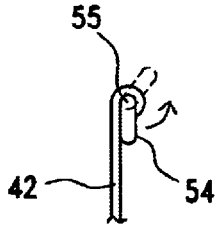
FIG. 11 is a side view of a portion of the spring element shown in FIG. 10 showing in dotted line the pivotal movement of a ring associated therewith.

To facilitate the retention of the torsion spring element in a predetermined adjusted position, in the embodiment shown in the drawing figures, the upper end portion 43 of the torsion spring element may be provided either with a fixed hook 52 or with a pivotal bail or D-ring type hook 54 which is pivotal about an axis 55, as is illustrated in FIGS. 10 and 11. The pivotal bail 54 allows an individual to grasp the bail and rotate it, as shown in dotted line in FIG. 11, in order to facilitate the removal of the spring element relative to the stirrup leather to permit adjustment.

In some embodiments, it may not be necessary to provide slots 47 for allowing cooperative passage of a buckle element as previously described. In other embodiments, the torsion spring elements which include the hooked or bail end portions may also include the spaced slots 47 for permitting cooperative passage of a buckle element.

In the use of the stirrup leather of the present invention, the stirrup may be fabricated at a manufacturing facility to include the torsion spring element mounted generally within the body of the strap 25. The spring element may be provided with a predetermined amount of torsional twist, such as the illustrated 90 degree twist illustrated in FIG. 9 of the drawings. After a rider purchases the stirrup leather or a saddle with the stirrup leathers and places the saddle into use, the amount of torsion to properly orient the stirrups 22 relative to the saddle seat 21 may be adjusted by providing a twisting motion as illustrated in FIG. 2. Thereafter, the length of the stirrup straps are adjusted utilizing buckle elements which may be conventional or as previously described wherein the buckle keeper element may be passed through the spaced slots 47 formed along the torsion spring elements.

In the preferred embodiment, when the torsion spring element is vertically adjustable, the spring element may be removed from the stirrup strap allowing the length of the strap to be selectively adjustable by the rider. Thereafter, the torsion spring element may be inserted within a predetermined opening 50 along the rear surface of the stirrup strap and thereafter seated within the channel 45 until the hooked end or bail portion seats against the edge of the opening 50 thereby retaining the torsion spring in a predetermined position. By properly positioning the torsion spring element relative to length of the stirrup strap, optimum torsion effect may be obtained. Because of the internal positioning of the torsion element within the stirrup leather, the torsion elements are esthetically concealed and are not subject to accidental contact which could result in their displacement.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A stirrup leather for suspending a stirrup from a saddle seat, the stirrup leather including a strap having an upper end portion adapted to be connected to a saddle seat and a lower end portion adapted to support a stirrup, said strap having a front portion and a rear portion, a generally enclosed open vertical channel defined between said front portion and said rear portion, an elongated torsion spring element removably mounted in said open channel for providing a force to provide a predetermined twist to said strap along a longitudinal axis thereof so as to orient a stirrup in a predetermined angular relationship to a saddle seat when the stirrup leather is connected between a stirrup and a saddle seat, and at least one opening in said strap communicating with said open channel for allowing sliding insertion and removal of said torsion spring element from said open channel.

2. The stirrup leather of claim 1 wherein said at least one opening in said strap is in said rear portion of said strap for allowing insertion and removal of said torsion spring element relative to said open channel, and said torsion spring element including an upper end portion including means for suspending said torsion spring element from said strap adjacent said at least one opening.

3. The stirrup leather of claim 2 in which said torsion spring element includes a generally elongated flat body which may be selectively twisted about an elongated axis thereof in order to provide a predetermined torque relative to said elongated axis thereof.

4. The stirrup leather of claim 3 in which said torsion spring element is formed of a material such that said stirrup may be rotated relative to said longitudinal axis by force of a rider's feet but will return the stirrup to said predetermined angular relationship when any such force is removed.

5. The stirrup leather of claim 3 including at least one slot formed through a portion of said body, and said slot being of a size to permit a keeper of a buckle of said strap to be inserted therethrough.

6. The stirrup leather of claim 5 including a plurality of vertically spaced slots formed in said body.

7. The stirrup leather of claim 6 wherein said upper end portion of said strap is formed into a closed loop and said lower end portion of said strap is formed into a closed loop, a buckle element including keeper pivotally mounted within said closed loop formed at said lower end portion.

8. The stirrup leather of claim 5 including a plurality of vertically spaced openings in said rear portion of said strap of a size to permit said torsion spring element to be inserted therethrough into said open channel.

9. The stirrup leather of claim 3 wherein said means for suspending includes a hook element formed along said upper portion of said torsion spring element.

10. The stirrup leather of claim 9 including at least one slot in said body spaced from said upper end portion of said torsion spring element, and said slot being of a size to permit a keeper of a buckle of said strap to be inserted therethrough.

11. The stirrup leather of claim 3 wherein said means for suspending includes a pivotable bail provided along said upper portion of said torsion spring element.

12. The stirrup leather of claim 11 including at least one slot in said body spaced from said upper end portion of said torsion spring element, and said slot being of a size to permit a keeper of a buckle of said strap to be inserted therethrough.

13. The stirrup leather of claim 3 including a plurality of vertically spaced openings in said rear portion of said strap of a size to permit said torsion spring element to be inserted therethrough into said open channel.

14. The stirrup leather of claim 13 in which said strap is formed of an outer generally continuous first material and an inner generally continuous lining material, said open channel being formed between of said inner lining material and said rear portion of said strap.

15. A stirrup leather for suspending a stirrup from a saddle seat, the stirrup leather including a strap having an upper portion adapted to be connected to a saddle seat and the lower portion adapted to support a stirrup, said strap having a front portion and a rear portion, a buckle carried by said lower portion of said strap and including a keeper element, a plurality of vertically spaced adjustment openings through said front and rear portions of said strap through which said keeper element is selectively received so as to adjust an effective length of said strap between a saddle seat and a stirrup, a generally confined open channel defined between said front portion and said rear portion, an elongated torsion spring element mounted in said open channel for providing a force to provide a predetermined twist to said strap along a longitudinal axis thereof so as to orient a stirrup in a predetermined angular relationship to a saddle seat when the stirrup leather is connected between a stirrup and a saddle, and said elongated torsion spring element having a generally flat body portion having a plurality of vertically spaced openings therethrough which are aligned with the vertically spaced adjustment openings of said strap and which are of a size to permit said keeper element to be inserted therethrough whereby said strap may be adjusted in length while the predetermined twist is maintained relative to the longitudinal axis.

16. The stirrup leather of claim 15 wherein said elongated torsion spring element is removably mounted within said open channel and includes an upper end portion for suspending said body portion within said open channel and which upper end portion is engageable to remove said elongated torsion spring element from said open channel.

17. A saddle including saddle seat, a pair stirrup leathers and a pair of stirrups mounted to said stirrup leathers, each of said stirrup leathers including, a strap having an upper portion connected to said saddle seat and a lower portion connected to a stirrup, each of said straps having a front portion and a rear portion, a generally enclosed open vertical channel defined between said front portion and said rear portion of each of said straps, an elongated torsion spring element removably mounted in each of said open channels for providing a force to provide a predetermined twist to said straps along a longitudinal axis thereof so as to orient said stirrups in a predetermined angular relationship to said saddle seat when the saddle is placed on a mount, and at least one opening in each of said straps communicating with said open channels for allowing sliding insertion and removal of said torsion spring elements relative to said open channels.

18. A saddle including saddle seat, a pair stirrup leathers and a pair of stirrups mounted to said stirrup leathers, each of said stirrup leathers including, a strap having an upper portion connected to said saddle seat and a lower portion connected to a stirrup, each of said straps having a front portion and a rear portion, a generally enclosed open channel defined between said front portion and said rear portion of each of said straps, a torsion spring element removably and adjustable mounted in each of said open channels for providing a force to provide a predetermined twist to said straps along a longitudinal axis thereof so as to orient said stirrups in a predetermined angular relationship to said saddle seat when the saddle is placed on a mount, said torsion spring elements being formed of a material such that said stirrups may be rotated relative to said longitudinal axes by force of a rider's feet but will return the stirrups to said predetermined angular relationship when any such force is removed, and at least one opening each of in said straps communicating with said open channels for allowing sliding insertion and removal of said torsion spring elements relative to said open channels.

19. The saddle of claim 18 wherein a buckle is carried by said lower portion of each of said straps and includes a keeper element, a plurality of vertically spaced adjustment openings through said front and rear portions of each of said straps through which said keeper elements are selectively received so as to adjust an effective length of said straps between said saddle seat and said stirrups, each of said elongated torsion springs having a generally flat body portion having a plurality of vertically spaced openings therethrough which are aligned with the vertically spaced adjustment openings of said straps and which are of a size to permit said keeper elements to be inserted therethrough whereby said straps may be adjusted in length while the predetermined twist is maintained relative to the longitudinal axes.

* * * * *